US005242340A

United States Patent [19]

Jerome

[11] Patent Number: 5,242,340

[45] Date of Patent: Sep. 7, 1993

[54] LOW IMPACT EXERCISE APPARATUS

[76] Inventor: Henry Jerome, 1689 Sherway Drive, Mississauga, Ontario, Canada, L4X 1C8

[21] Appl. No.: 844,154

[22] Filed: Mar. 2, 1992

[51] Int. Cl.[5] ..... A63B 22/04; A63B 22/14

[52] U.S. Cl. ..... 482/52; 482/116; 482/147

[58] Field of Search ..... 482/52, 53, 51, 146, 482/147, 71, 114, 115, 116, 120

[56] References Cited

U.S. PATENT DOCUMENTS

| | | | |
|---|---|---|---|
| 3,506,262 | 4/1970 | Wade . | |
| 3,544,105 | 12/1970 | Latta . | |
| 3,834,693 | 9/1974 | Poppenberger | 482/71 |
| 4,284,272 | 8/1981 | Evans et al. . | |
| 4,293,127 | 10/1981 | Dudley . | |
| 4,521,010 | 6/1985 | Hahn . | |
| 4,558,861 | 12/1985 | Gall . | |
| 4,600,187 | 7/1986 | Schenker . | |
| 4,659,075 | 4/1987 | Wilkinson . | |
| 4,659,077 | 4/1987 | Stropkay . | |
| 4,708,338 | 11/1987 | Potts | 482/52 |
| 4,838,543 | 6/1989 | Armstrong et al. . | |
| 4,934,690 | 6/1990 | Ball . | |
| 4,944,510 | 7/1990 | Brady . | |
| 4,949,993 | 8/1990 | Stark et al. | 482/52 |
| 5,007,631 | 4/1991 | Wang | 482/52 |
| 5,078,389 | 1/1992 | Chen | 482/147 |

*Primary Examiner*—Stephen R. Crow

*Attorney, Agent, or Firm*—Dressler, Goldsmith, Shore, Sutker & Milnamow, Ltd.

[57] ABSTRACT

An exercise apparatus for simulating stair climbing, stair hopping and downhill skiing is disclosed. The apparatus includes a base with a vertical support extending upwardly therefrom and a handrail supported by the vertical support. Two foot pedals are pivotally connected to the vertical support. Each foot pedal has a roller chain connected at one end to the foot pedal. A spring is connected between the other end of each roller chain and the foot pedal at a position spaced from the point of connection of the roller chain. The two roller chains are looped over drive chain sprockets which are rotatably mounted by clutch bearings on a shaft in spaced apart relation. The drive shaft extends through and is rigidly secured to a friction drum. A chord is looped around the drum between a spring bias and a length adjustable rod thereby forming a variable resistance mechanism. Depressing the foot pedals results in the clutch bearings engaging the shaft thereby rotating the friction drum. The force required to depress the foot pedals is set by adjusting the resistance mechanism. Releasing the foot pedal causes the bearing to disengage from the shaft and the bias springs return the pedal to the up position.

11 Claims, 5 Drawing Sheets

LOW IMPACT EXERCISE APPARATUS

FIELD OF THE INVENTION

The present invention relates to a low impact exercise apparatus for stair climbing, stair hopping, downhill skiing exercises, and the like.

BACKGROUND OF THE INVENTION

Exercise equipment for simulating stair climbing is well known. One type of apparatus is directed only to stair climbing applications while another type includes additional equipment for simultaneously exercising certain muscles of the upper body. The resistance forces are generated in these devices using hydraulic cylinders including shock absorbers or electromagnetic means and as a consequence require regular maintenance. A drawback to the use of hydraulic cylinders is that the cylinder offers resistance to both extension and retraction, so that the foot pedals are usually pivoted together in some fashion whereby the user stepping on one pedal is assisting in moving the other pedal to the undepressed position.

Accordingly, it would be advantageous to provide an exercise apparatus which can be utilized to provide a multiplicity of exercise motions that give both an aerobic and anaerobic type of workout and that will exercise the arms, legs and upper body, and which is sturdy, inexpensive to manufacture and requires minimal maintenance.

The present invention provides a low impact exercise apparatus for simulating stair climbing, stair hopping, downhill skiing or for controlled arm dips. The exercise apparatus includes a frame having a base for resting on a supporting surface. A pair of laterally spaced foot pedals are pivotally attached to the frame with each foot pedal being independently operable of the other. Provided are biasing means for upwardly biasing the pedals. The exercise apparatus includes a friction brake means for resisting pivotal movement of the foot pedals. The friction brake means comprises a friction drum rotatably mounted on the frame. There is provided drive belt means connecting each foot pedal with the friction drum for driving the friction drum in one direction when at least one of the foot pedals is depressed. The apparatus includes a tension cable means operably coupled to the friction drum for frictionally engaging the drum during movement of the drum. There is provided means for adjusting the frictional engagement of the tension cable means with the friction drum.

BRIEF DESCRIPTION OF THE DRAWINGS

The following is a description, by way of example only, of various embodiments of the exercise apparatus of the present invention, reference being had to the accompanying drawings, in which.

DETAILED DESCRIPTION OF THE PREFERRED EMBODIMENT

Figure 1:
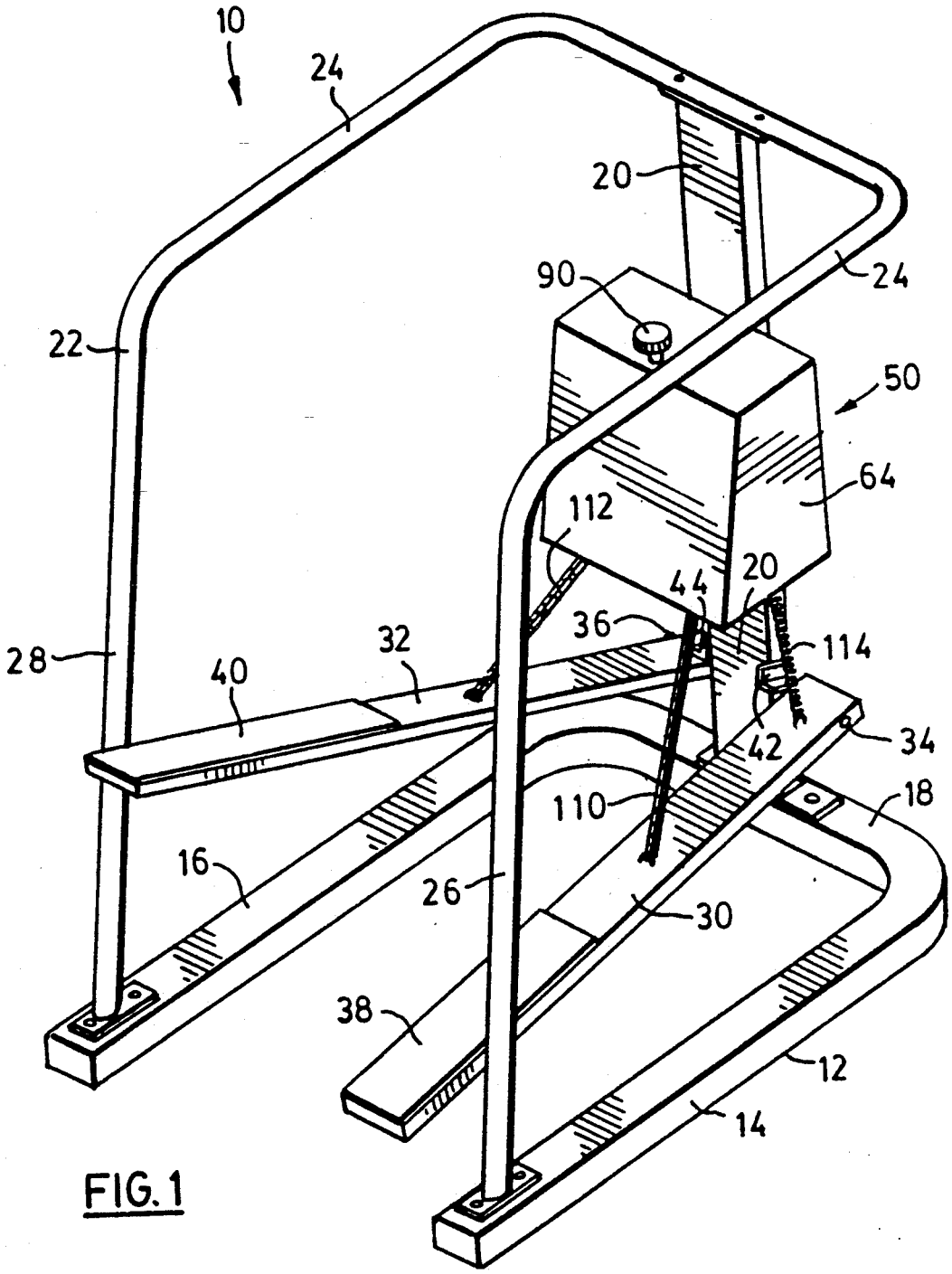
FIG. 1 is a perspective view of an exercise apparatus constructed in accordance with the present invention showing one pedal depressed as if in operation.
Figure 2:
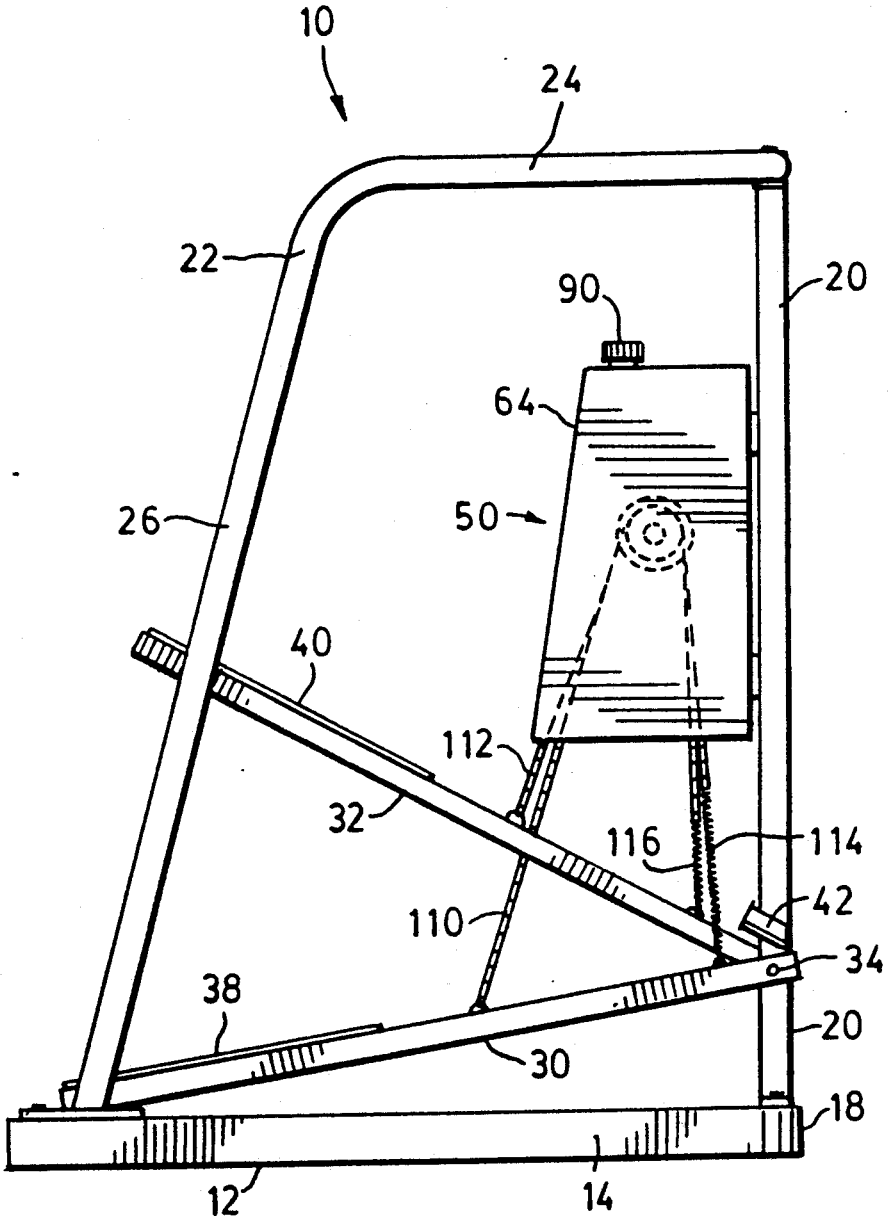
FIG. 2 is a side elevation of the apparatus shown in FIG. 1.

Referring to FIGS. 1 and 2, there is shown an exercise apparatus 10 embodying the subject invention. Exercise apparatus 10 is provided with a frame comprising a generally U-shaped base member 12 provided with two parallel spaced arms 14 and 16 which are connected by a third arm 18. The frame includes a substantially vertical support member 20 connected to, and extending upwardly from arm 18. Apparatus 10 includes a hand-rail 22 having a U-shaped portion 24 spaced above and generally parallel to base 12 and hand-rail 22 incudes vertical portions 26 and 28 secured to arms 14 and 16 respectively. The parallel arms of the U-shaped portion 24 are spaced a predetermined distance which is greater than the average shoulder width so that it may be comfortably gripped for doing tricep dips as will be discussed below.

Apparatus 10 is provided with a pair of generally parallel foot pedals 30 and 32 each of which is pivotally attached at one end thereof to vertical support member 20 by pivot pins 34 and 36 respectively at a distance spaced above arm 18. Foot pedals 30 and 32 are provided with non-skid foot pads 38 and 40 respectively mounted thereto at the ends of the pedals spaced from the pivotal connection. A pair of stop brackets 42 and 44 are secured to upright member 20 and positioned to limit the upward swing of pedals 30 and 32 respectively.

Figure 3:
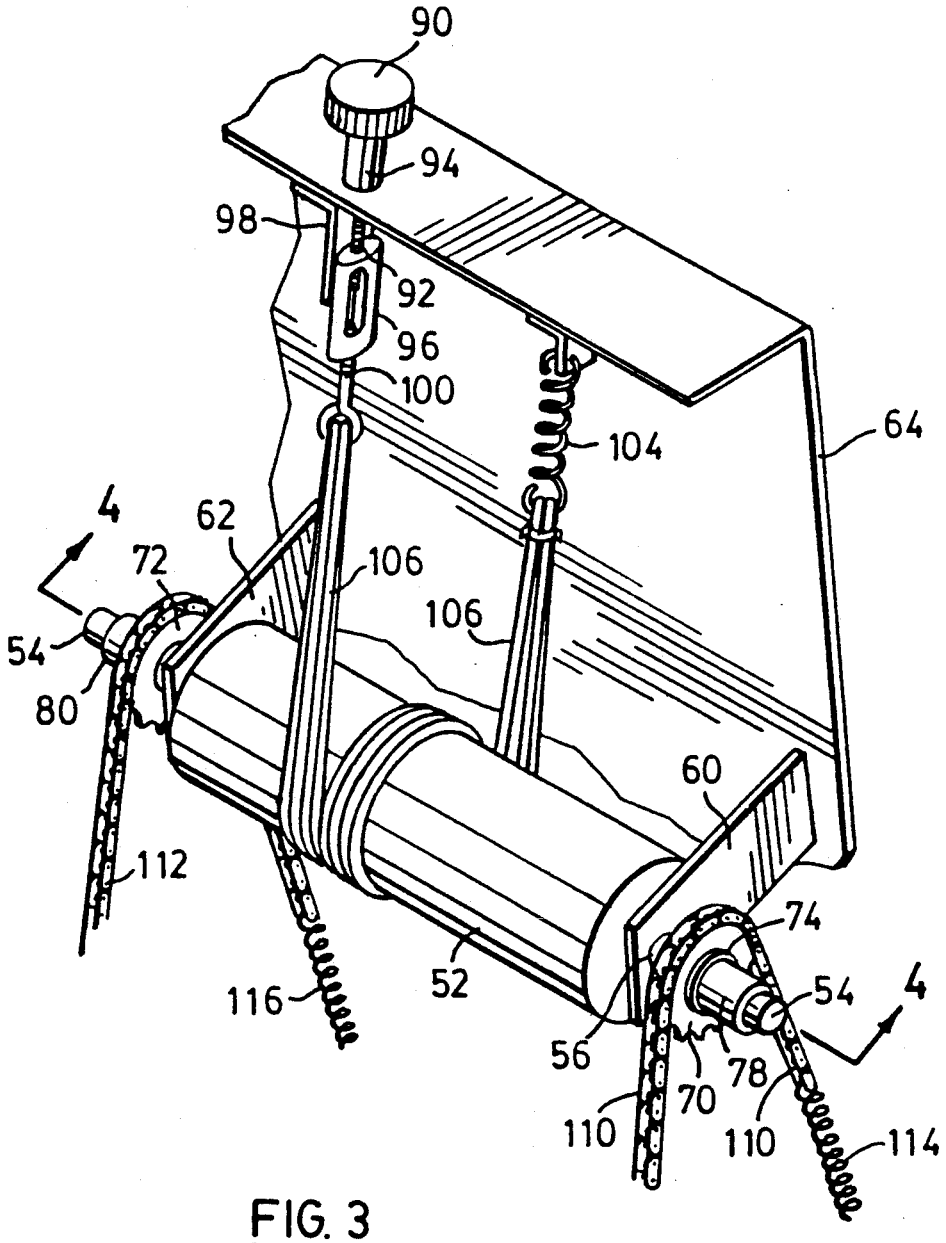
FIG. 3 is a perspective view of a portion of a friction brake assembly forming part of the present invention.
Figure 4:
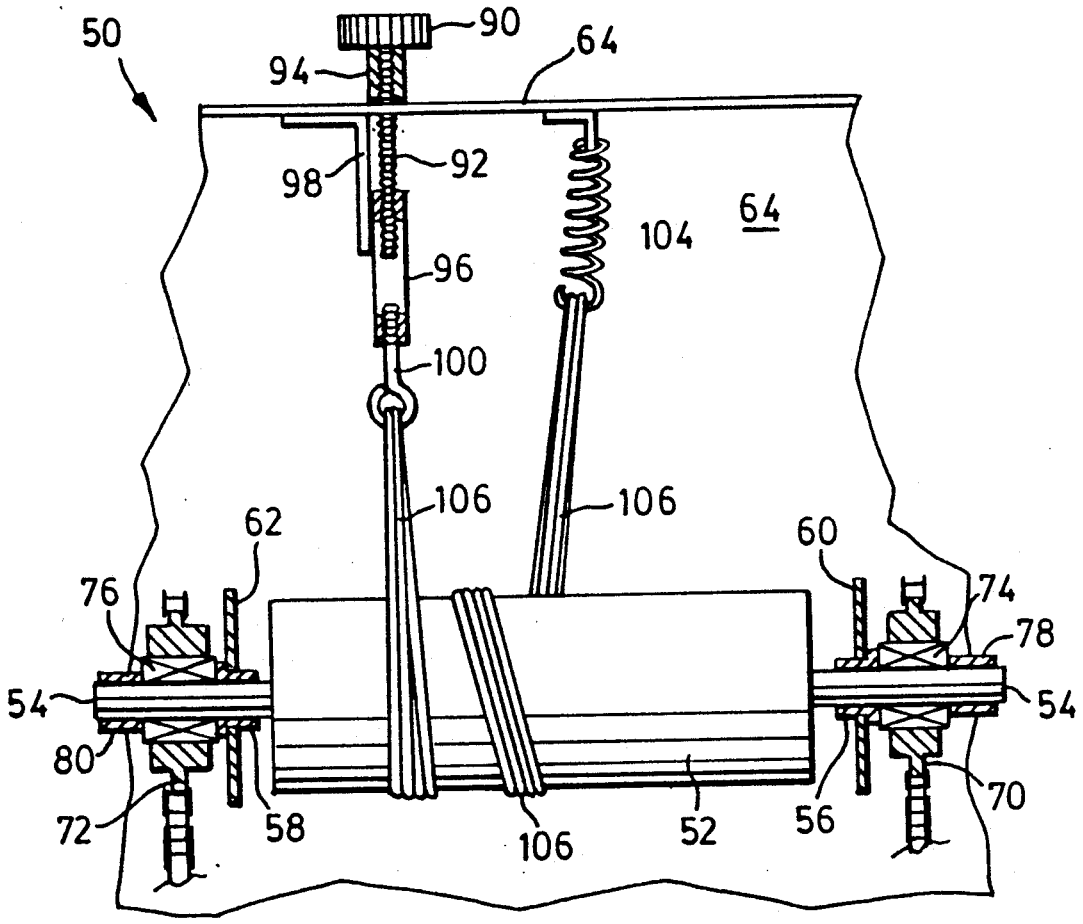
FIG. 4 is a sectional view of the friction brake taken along line 4—4 of FIG. 3.

Referring to FIGS. 3 and 4, exercise apparatus 10 includes a friction brake assembly shown generally at 50. The friction brake assembly includes a friction drum 52 having a shaft 54 extending therethrough along the drum longitudinal axis and rigidly secured to the drum. Shaft 54 is rotatably mounted through bearings 56 and 58 which are in turn mounted in support arms 60 and 62. Support arms 60 and 62 are rigidly secured to a housing frame 64. A pair of drive chain sprockets 70 and 72 are mounted on shaft 54, one on each side of drum 52. Drive chain sprockets 70 and 72 each contains a clutch bearing 74 and 76 respectively which is rotatably mounted on shaft 54. Locking collars 78 and 80 are mounted on the ends of shaft 54 in order to lock sprockets 70 and 72 in place on the shaft.

Friction brake assembly 50 includes a tension cable 106 and a cable tightening means, which in this embodiment includes a tension adjustment knob 90 carrying a threaded shaft 92 secured thereto. Knob 90 is maintained a fixed distance from frame 64 by a sleeve 94. Threaded shaft 92 is threaded through one end of a turnbuckle 96. A stop bracket 98 is rigidly secured to frame 64 and lies adjacent turnbuckle 96 in order to prevent the turnbuckle from rotating when knob 90 is rotated. An eye bolt 100 extends from the other end of turnbuckle 96 and is rigidly secured thereto. Friction brake assembly 50 is provided with a bias spring 104 secured to frame 64. Tension cable 106 interconnects spring 104 and eye bolt 100 with a plurality of loops engaging drum 52. In one embodiment tension cable 106 is looped to form four circumferential passes around drum 52.

While tension cable 106 has been described as being one long cable looped back and forth between eye bolt 100 and spring 104, it will be understood that it could also comprise a plurality of parallel chords extending between the eye bolt and the spring and wrapped around the drum. In addition, cable 106 could also comprise a wide belt looped around drum 52 between eye bolt 100 and spring 104.

Friction brake assembly 50 is operably coupled to foot pedals 30 and 32 by drive belt means, which in this embodiment comprise roller chains 110 and 112 respectively. The roller chains are each connected at one end thereof to the foot pedals and are looped over and engage chain sprockets 70 and 72. The other ends of roller chains 110 and 112 are secured to bias springs 114 and 116 which in turn are attached to foot pedals 30 and 32 respectively at points spaced from the connections of the other ends of the chains to the pedals.

Preferably, tension cable 106 is fabricated of a high strength, low stretch, heat resistant aromatic polyamide fiber, commonly known as an aramid fiber and marketed under the trade marks of KEVLAR (Dupont), TECHNORA in Japan and TWARON in the Netherlands. This material is readily able to withstand the heat generated during rotation of the drum.

In this embodiment friction drum 52 is preferably fabricated of steel and is provided with a chrome plating to provide a hardened drum surface that will withstand, without significant wear, the very high pressures exerted by chord 106. Those skilled in the art will appreciate that other similar hardened coatings may be used rather than chromium.

In operation, as a user steps down on raised foot pedal 32, chain 112 drives chain sprocket 72 so that clutch bearing 76 engages shaft 54 thereby rotating chain sprocket 72 counterclockwise (as seen in FIG. 3). The tension or resistance offered to the foot pedals by friction brake 50 is increased by rotating tension knob 90 so that turnbuckle 96 and eye bolt 100 are drawn upwards toward the knob which acts to tighten cord 106 looped around drum 52 thereby giving rise to increased tension. When the user raises his or her left leg drive chain 112 rotates drive sprocket 72 clockwise thereby disengaging clutch bearing 76 from drive shaft 54. When this occurs, spring 116 returns foot pedal 32 to the up position which is reached when pedal 32 abuts stop bracket 44. Foot pedal 30 operates in an analogous fashion independent of pedal 32.

A user may simulate stair walking by adjusting the tension of tension cable 106 by rotating knob 90, standing on foot pedals 30 and 32, gripping the upper handrail portion 24 and then "walking" on the spot. With tension cable 106 appropriately adjusted, the user will experience resistance against the pedals being pushed down which acts to simulate stair climbing.

In order to simulate stair hopping by jumping with both feet apart but moving up and down together, the user grips the upper portion 24 of the hand-rail and "hops" up and down. With tension cable 106 appropriately adjusted, the user will experience a resistance to both pedals 30 and 32 being depressed downwards at the same time which acts to simulate stair hopping.

In order to perform controlled arm dips, the user stands on foot pedals 30 and 32 and grips hand-rail portion 24 and does tricep dips by bending at the elbows. With tension cable 106 appropriately adjusted the user will not freely drop due to the resistance offered by the foot pedals, and the user will not have to lift his or her entire body weight from the lower position since springs 114 and 116 will aid in lifting the user as the springs return pedals 30 and 32 to the up position. In this way, controlled dips may be performed wherein the effective weight on the user's arms during the down and up movement is less than the user's body weight and is adjustable.

Figure 5:
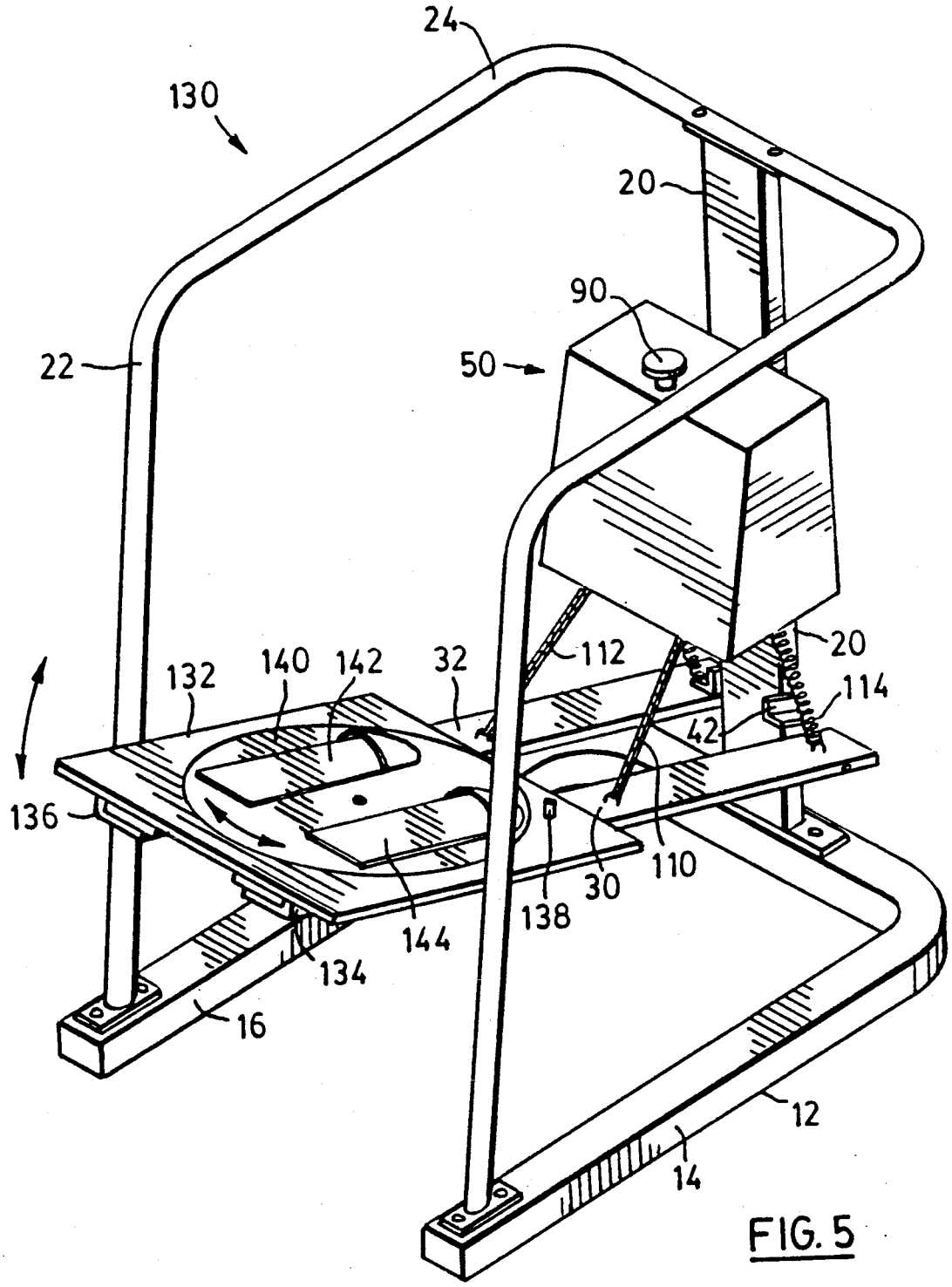
FIG. 5 is a perspective view of another embodiment of the low impact exercise apparatus for simulating downhill skiing.

Referring now to FIG. 5, another embodiment of a low impact exercise apparatus constructed in accordance with the present invention is shown at 130 which is similar to apparatus 10 of FIGS. 1 and 2 but modified to provide downhill skiing simulation exercises. Apparatus 130 includes a swivel means which in this embodiment includes a platform 132 with guides 134 and 136 attached to the underside of the platform to receive pedals 30 and 32. A locking pin 138 mounted in platform 132 engages a hole (not shown) in pedal 30 to lock platform 132 in place. A table 140 is rotatably mounted on platform 132 and is provided with left and right foot rests 142 and 144 respectively.

In the operation of the embodiment of FIG. 5, to simulate downhill skiing and mogul type skiing the user stands on foot rests 142 and 144, grips handrail portions 24 and operates both feet in unison similar to the stair hopping exercise described above while at the same time rotating the feet to the left on one hop and then to the right on the next hop. Repeating this routine over and over again closely simulates the side-to-side and up/down motion the body experiences in downhill skiing.

While the low impact exercise apparatus embodying the subject invention has been described and illustrated with respect to the preferred embodiment, it will be appreciated that numerous variations of these embodiments may be made without departing from the scope of the invention described herein.

I claim:

1. A low impact exercise apparatus for simulating stair climbing and stair hopping, comprising:

a) a frame having a base for resting on a supporting surface;

b) a pair of laterally spaced foot pedals pivotally attached to the frame, each foot pedal being independently operable;

c) means for upwardly biasing said pedals; and d) friction brake means for resisting pivotal movement of the foot pedals, said friction brake means comprising a friction drum rotatably mounted on said frame, including drive belt means connecting each foot pedal and said friction drum for driving said friction drum in one direction when at least one of said foot pedals is depressed, including a tension cable means operably coupled to said drum for frictionally engaging the drum during movement of the drum; and means for adjusting the frictional engagement of said tension cable means with said friction drum.

2. An exercise apparatus according to claim 1 wherein said tension cable comprises a manually adjustable knob rotatably mounted to said frame, a turnbuckle, a threaded shaft secured at one end to the knob and the other end threadedly engaged through the turnbuckle, a spring attached at one end to said frame, the tension cable being attached at one end of the spring looped around the drum and attached at the other end to the turnbuckle, whereby rotating the knob in one direction tightens the cable about the friction drum and rotating the knob in the other direction loosens the cable.

3. An exercise apparatus according to claim 1 wherein said tension cable is fabricated of a high strength heat resistant aramid fibre.

4. An exercise apparatus according to claim 2 wherein said friction drum is fabricated of steel and is provided with a chrome plating to provide a hardened drum surface.

5. An exercise apparatus according to claim 1 wherein the friction drum includes a shaft securely mounted along the longitudinal axis of said drum and extending from each end of said drum, the shaft being rotatably mounted on said frame, a pair of sprockets each having a clutch bearing, the sprockets being mounted on said shaft one on each side of said drum and each sprocket located one above each foot pedal, the drive belt means comprising a pair of roller chains looped one over each sprocket, whereby the clutch bearing engages said shaft when the foot pedal is depressed thereby rotating said shaft and friction drum, and the clutch bearing being disengaged from the shaft when the foot pedal is released.

6. An exercise apparatus according to claim 1 including a handrail attached to said frame, wherein said handrail includes a pair of spaced portions thereof which are parallel to said base and spaced a predetermined distance above said base, said handrail being provided for performing controlled arm dips.

7. An exercise apparatus according to claim 1 wherein said means for upwardly biasing said pedals comprises a pair of springs one associated with each foot pedal, each spring being attached at one end to the drive belt means and at the other end to the foot pedal at a position spaced from connection of the drive belt to the foot pedal.

8. An exercise apparatus according to claim 1 wherein said frame includes a substantially vertically upright member extending between said base and said handrail, the foot pedals being pivotally attached one on each side of the vertical member a predetermined distance above said base.

9. An exercise apparatus according to claim 8 including a pair of stop brackets mounted on the vertical member and spaced one above each foot pedal for stopping the upward movement of said foot pedals.

10. An exercise apparatus according to claim 6 including swivel means removably mounted on said foot pedals, the swivel means having a top surface on which a user can stand, whereby a user standing thereon can swivel from side-to-side.

11. An exercise apparatus according to claim 1 including swivel means removably mounted on said foot pedals, said swivel means comprises a platform, a swivel member rotatably mounted on the platform, means for securing said platform to said foot pedals, whereby, a user standing on said swivel member can swivel side-to-side.

* * * * *